US007665411B2

(12) United States Patent
Welch

(10) Patent No.: US 7,665,411 B2
(45) Date of Patent: Feb. 23, 2010

(54) SYSTEM AND METHOD FOR A TOW-ROPE RETRACTION DEVICE FOR WATERCRAFT

(75) Inventor: John Welch, Orem, UT (US)

(73) Assignee: John M. Welch, Orem, UT (US)

( * ) Notice: Subject to any disclaimer, the term of this patent is extended or adjusted under 35 U.S.C. 154(b) by 797 days.

(21) Appl. No.: 11/069,615

(22) Filed: Feb. 28, 2005

(65) Prior Publication Data

US 2006/0027155 A1 Feb. 9, 2006

Related U.S. Application Data

(60) Provisional application No. 60/599,273, filed on Aug. 6, 2004.

(51) Int. Cl.
*B63B 21/56* (2006.01)
*B63B 21/16* (2006.01)
*B63B 35/85* (2006.01)

(52) U.S. Cl. ..... 114/253; 114/254; 441/69

(58) Field of Classification Search ..... 114/253, 114/254, 242, 247; 441/69
See application file for complete search history.

(56) References Cited

U.S. PATENT DOCUMENTS

| | | | | |
|---|---|---|---|---|
| 3,303,813 | A * | 2/1967 | Collins et. al. | 114/254 |
| 3,398,715 | A * | 8/1968 | Burg | 114/244 |
| 3,742,490 | A * | 6/1973 | Henderson | 340/815.83 |
| 3,780,989 | A * | 12/1973 | Peterson | 254/273 |
| 6,505,573 | B1 * | 1/2003 | Sheikholeslam et al. | 114/254 |
| 6,672,238 | B2 | 1/2004 | Sheikholeslam et al. | |

* cited by examiner

*Primary Examiner*—S. Joseph Morano
(74) *Attorney, Agent, or Firm*—Steven L. Nichols; Rader, Fishman & Grauer PLLC

(57) ABSTRACT

A device used when towing a user with a watercraft includes a tow-rope and a tow-rope retraction device receiving the tow-rope. The tow-rope retraction device is configured to selectively retract the tow-rope so as to accelerate a user being towed by the watercraft on the tow-rope. A method of towing a user with a watercraft includes selectively retracting a tow-rope while towing the user to accelerate the user.

20 Claims, 6 Drawing Sheets

SYSTEM AND METHOD FOR A TOW-ROPE RETRACTION DEVICE FOR WATERCRAFT

RELATED APPLICATIONS

The present application claims the benefit under 35 U.S.C. § 119(e) of Provisional U.S. Patent Application No. 60/599,273, filed Aug. 6, 2004. This application is incorporated herein by reference in its entirety.

BACKGROUND

Water sports such as wake boarding have become increasingly popular. Due to the popularity of such water sports new technology has been developed to enhance the participant's experience.

Particularly, several measures have been taken to increase the size of the wake made by the watercraft that is towing a wake boarder or other type of water sport enthusiast, such as a wake skater, wake surfer or tuber. The size of the wake, which is the track left by a moving watercraft in the water, can determine how enjoyable the experience is for the user being towed. The higher and more voluminous the wake is, the greater vertical lift a wake boarder or watercraft sport enthusiast can achieve when moving over and springing off of the wake. With this greater vertical lift, the user can perform tricks and stunts that would not be possible with a smaller wake.

One way in which the wake is made bigger is by adding large amounts of weight to the boat or watercraft. This is often achieved by adding a water ballast system to the inside of the boat. A water ballast system will take on water when desired to cause the boat to ride lower and sink farther into the water, in other words, to increase the draft of the boat. When the boat then moves through the water, the increased draft causes the resulting wake to be larger.

While a ballast system does make a larger wake and does make it possible for the user to gain greater lift from the wake, it also has several disadvantages. For example, a ballast system causes the boat to experience a drastic decrease in fuel efficiency and handling, and creates all around greater wear and tear on the boat's mechanical parts.

Also, ballast systems are generally only available in newer boats for the purpose of increasing wake size. Older boats do not have such ballast systems, and ballast systems are extremely difficult to retrofit to older boats. When a ballast system is added to an older boat, the result is usually not cost effective and outweighs the advantages of a having a larger wake obtained through installing such a ballast system.

Another way in which a user can enhance the vertical lift he or she can achieve over the wake of a boat is to include a tower on the boat. The tow-rope is then attached to the top of the tower. By increasing the distance between the surface of the water and the point at which the tow-rope is attached to the boat, the skier or boarder being towed can exert force, pulling upward on the rope to achieve a greater vertical lift over the wake. The tower is typically a pylon or framework usually made of aluminum or other light metals.

SUMMARY

A device used when towing a user with a watercraft includes a tow-rope and a tow-rope retraction device receiving the tow-rope. The tow-rope retraction device is configured to selectively retract the tow-rope so as to accelerate a user being towed by the watercraft on the tow-rope. A method of towing a user with a watercraft includes selectively retracting a tow-rope while towing the user to accelerate the user.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Various systems and methods for implementing a tow-rope retraction system are disclosed herein. The tow-rope retraction system is used to achieve greater forward acceleration when a water sport enthusiast jumps the wake of a watercraft. Through the increased forward acceleration that the rapid tow-rope retraction provides, the user can achieve greater vertical lift as he or she shoots over the wake that the watercraft creates. The increased vertical lift makes it possible for the user to perform a wider variety of tricks or stunts and enhances the user's experience.

Figure 1:
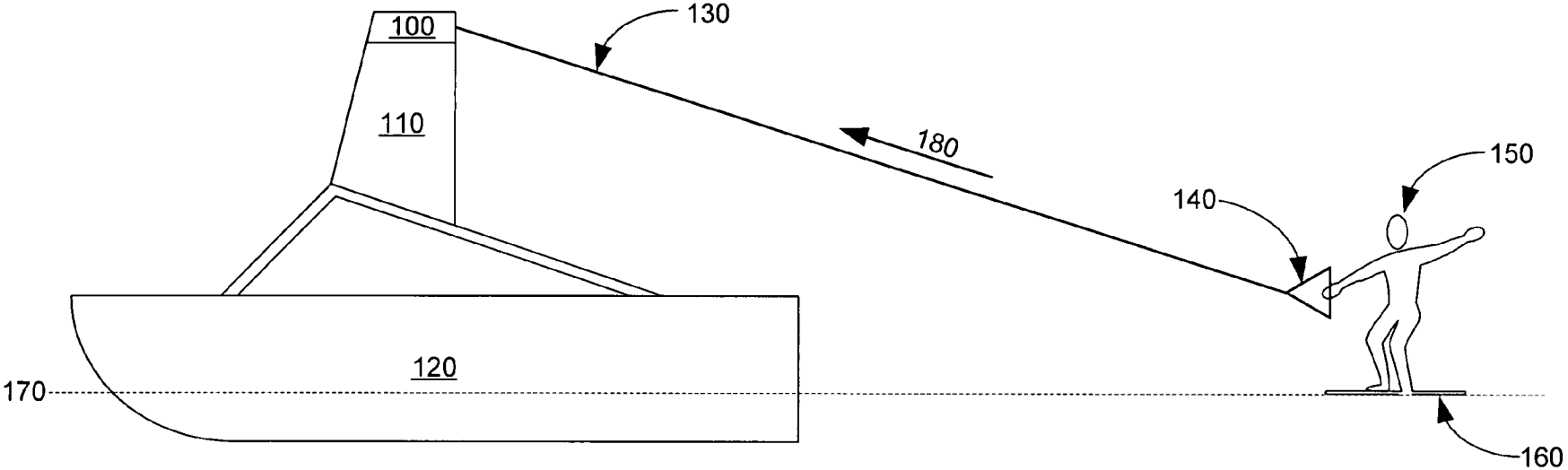
FIG. 1 illustrates a winch, tow-rope and tow-rope handle used in connection with a watercraft according to principles described herein.

FIG. 1 illustrates a tow-rope retraction device (100), tow-rope (130) and tow-rope handle (140) used in connection with a watercraft (120). While a boat is illustrated as the watercraft (120) in FIG. 1, it will be understood that the principles described herein can be applied to any watercraft (120) that can tow wake boarders and the like through water. The watercraft's engine must produce enough horse power and torque to be able to plane, or skim across the surface of the water and still pull one or more skiers, wake boarders, etc. For example, the watercraft (120) may be, but is not limited to, a boat, a wave-runner, a personal watercraft and the like.

As shown in FIG. 1, a tower or pylon (110) may be disposed on the watercraft (120). The tow-rope (130) is attached to the top of the tower so as to be attached to the towing watercraft (120) as far above the surface of the water (170) as possible. The tower (110) is connected to the watercraft (120) so as to be structurally sound enough to tow one or more skiers, wake boarders, etc. The tower (110) is usually made of a strong, light weight material such as aluminum and may be a single pylon or a frame. As used herein and in the appended claims, the term "tower" will be used to refer broadly to any structure that extends above the deck of a watercraft to which the tow-rope (130) is attached or belayed or to which a tow-rope retraction device (100) is attached for the purpose of increasing the distance between the surface of the water and the connection point between the tow-rope and watercraft.

In the example of FIG. 1, the tow-rope retraction device (100) is attached at the top of the tower (110) and receives the tow-rope (130). Thus, as described herein, the tow-rope (130) is not attached directly to the tower, but is connected to the tow-rope retraction device (100) that is attached to the tower (110). The tow-rope retraction device (100) can be positioned on the top of the tower (110) to increase the height above the surface of the water at which the tow-rope (130) is effectively connected to the watercraft (120). This provides additional vertical lift to the user as described above. It is also useful to place the tow-rope retraction device (100) at the top of the tower (110) so that the tow-rope (130) can be readily extended to the user (150) unobstructed. However, it will be understood by those skilled in the art that the tow-rope retraction device (100) described herein need not be mounted on a tower, but may be mounted directly to the deck or surface of the watercraft (120).

When the illustrated system is used, the user (150) holds onto the tow-rope handle (140) as both the watercraft (120) and the user (150) plane over the surface of the water (170). The user rides on some apparatus (160), such as water skies, a wake board, a knee board, a boogey board, an air-filled tube or the like. As used herein and in the appended claims, the term "board" will refer collectively to anything a user may ride on while being towed by a watercraft (120), including all the examples just mentioned. When the user passes over the wake, the tow-rope retraction device (100) can be activated to rapidly retract at least a portion of the tow-rope (130) and accelerate the user to provide greater vertical lift from jumping the wake.

In one example, the tow-rope retraction device (100) is a winch. In other examples, the tow-rope retraction device may be a piston or a lever. Any device that can be controlled to rapidly retract the tow-rope over at least a short distance to accelerate a user being towed by the rope may be used in the systems described herein.

If a winch (FIG. 2, 101) is used, a leader cable can be connected to the tow-rope (130). The leader cable would be wound into the winch and would be made out of a stronger material to withstand the wear and tear that would occur as the line is wound into and reeled out by the winch. This would extend the life of the tow-rope (130) by not having the tow-rope experience such wear and tear. In another example, the tow-rope (130) is made of a material that is flexible and light-weight enough to safely function as a tow-rope, but would be able to withstand the wear and tear that would occur as the tow-rope (130) is wound into and reeled out by the winch.

In other examples, the tow-rope retraction device (100) need not be disposed atop the tower (110). The same effect can be achieved by belaying the tow-rope through a pulley or other device on the tower (110). The tow-rope (130) then runs to the retraction device (100) located somewhere else on the watercraft (120), perhaps attached to the deck of the watercraft (120).

Figure 2:
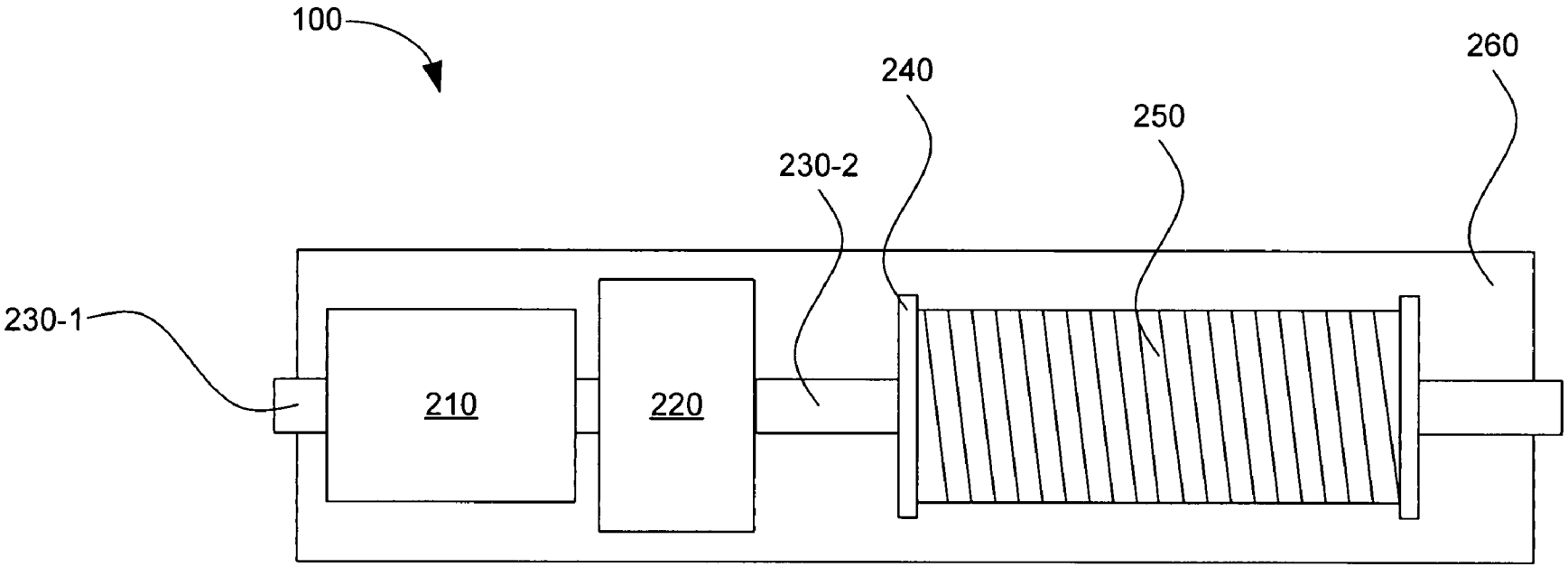
FIG. 2 illustrates a winch according to principles described herein.

FIG. 2 illustrates a winch (101) for use as the tow-rope retraction device (100) according to principles described herein. The winch's several elements may be contained within a winch housing (260). As described above, the winch (101) is attached to the watercraft (FIG. 1, 120), for example, to the top of the tower (FIG. 1, 110). The winch (101) is usually connected to the tower (FIG. 1, 110) via the winch housing (260).

Within the winch housing (260), a motor (210) is used to turn a first drive shaft (230-1). In one possible embodiment, the motor (210) is an electric motor which draws power from the electrical system of the watercraft (FIG. 1, 120). However, the motor (210) may be any of a variety of different units that develop energy or impart motion. These types of motors may include, but are not limited to, a hydraulic motor, a pneumatic motor, a mechanical spring system, an internal combustion engine, etc. As used herein and in the appended claims, the term "motor" will refer to any device that can cause rotation of the winch to wind up, or reel out, the tow-rope (250).

Depending on the type of motor user, the motor (210) may be connected to a gear box (220) via the first drive shaft (230-1). The gear box (220) contains a series of gears having gear ratio that will change the radial velocity and torque of the first drive shaft (230-1) into a specific radial velocity and torque that can be utilized as described herein. In one example, the gear box (220) provides a gear ratio that produces a radial velocity of 500 to 1000 or more RPMs. This radial velocity makes it possible for the user (FIG. 1, 150) to experience a strong pull or an increase in acceleration through the tow-rope and winch combination. As previously mentioned, this acceleration will allow the user (FIG. 1, 150) to achieve greater vertical lift over the watercraft's wake. As will be described in more detail below, the gear box (220) may be adjustable so that a user can vary the speed at which the tow-rope (250) is wound by the winch (101).

In some examples, the gear box (220) is connected to a second drive shaft (230-2). The second drive shaft (230-2) is connected to the cable drum (240) such that, as the second drive shaft (230-2) is driven by the gear box (220), the cable drum (240) is driven by the second drive shaft (230-2). The tow-rope (250) is then coiled around, or uncoiled from, the cable drum (240).

In one example, when the winch (101) is activated, it will rapidly pull in a predetermined amount of tow-rope (250) to create a pull or tug on the rope (130) that accelerates the user (FIG. 1, 150). The user (FIG. 1, 150) can selectively activate the winch (101) remotely, as will be described in more detail below, so as to shorten the tow-rope (FIG. 1, 130) and receive an accelerating tug on the rope just as he or she is jumping the wake of the watercraft (120). This will allow the user (150) to jump higher with more vertical lift from the wake of the watercraft (120). As described above, this enhances the user's experience and may enable the user (150) to perform better or additional stunts or tricks than would be possible without the acceleration provided by the winch (101). As will be described below, the user (150) can also remotely re-extend the tow-rope (130) so as to set up for another accelerating retraction of the tow-rope (130) when again crossing the wake. These same principles apply to any tow-rope retraction device as described herein.

Figure 3:
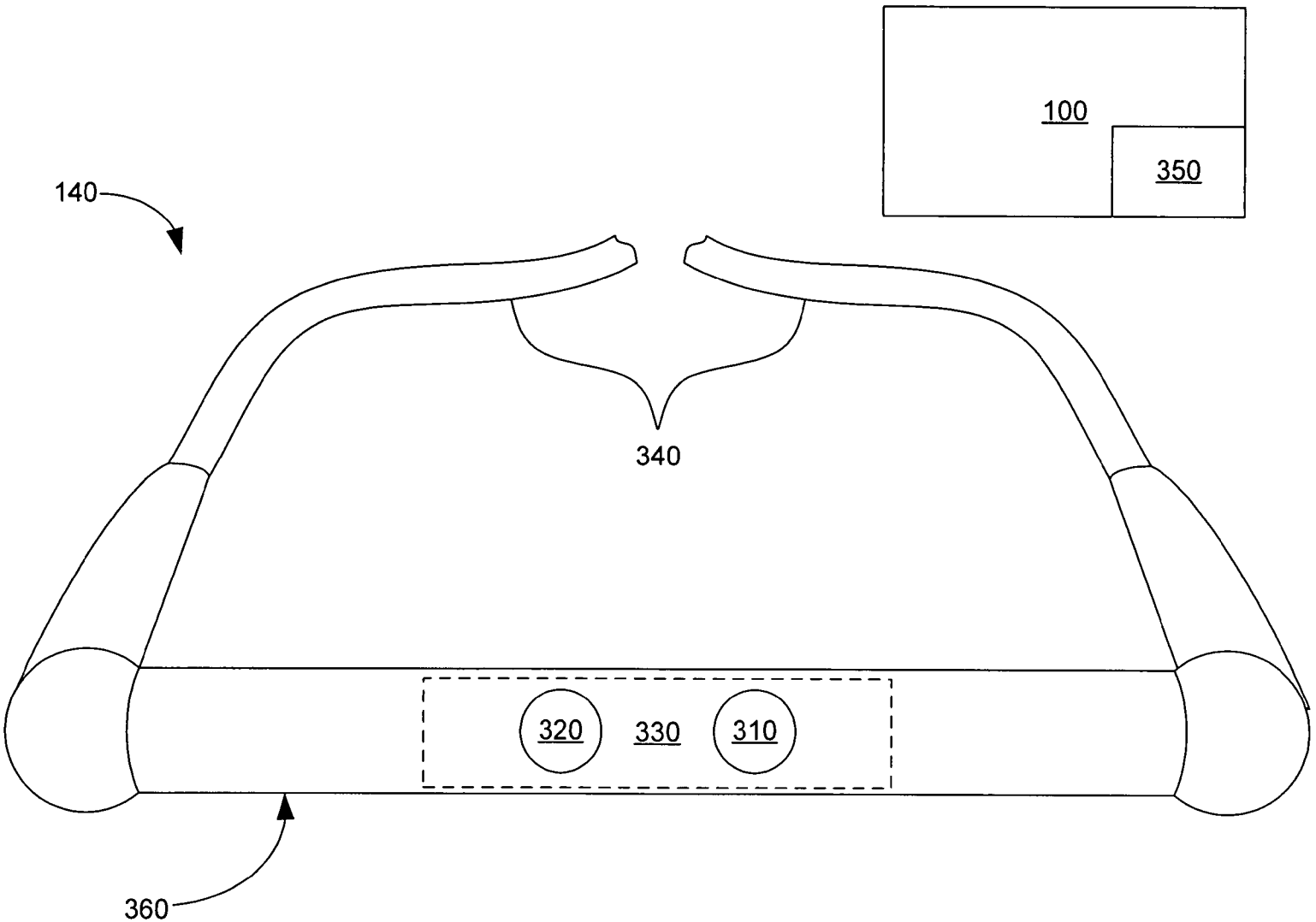
FIG. 3 illustrates a tow-rope handle incorporating a wireless remote system according to principles described herein.

FIG. 3 illustrates a tow-rope handle (140) incorporating a wireless remote system. According to principles described herein, the tow-rope retraction device (100) is supplied with a control system (350) that includes a wireless receiver. The tow-rope handle (140) is also supplied with a wireless transmitter (330). This wireless remote system can be, for example, a radio frequency or radio controlled system.

The tow-rope handle consists of a handle portion (360), a rope portion (340) and the wireless transmitter (330). The transmitter (330) includes a retraction button (310) and an extension button (320), and may be attached to, or embedded in, the handle portion (360) of the tow-rope handle (140). Alternatively, the transmitter (330) could be voice activated.

While being pulled behind the watercraft, the user (FIG. 1, 150) can selectively push the retraction button (310) or give a voice command when jumping the wake of the watercraft. The wireless transmitter (330) then transmits a command signal to the wireless receiver (350). The wireless receiver (350) then actuates the tow-rope retraction device (100), and the device (100) rapidly retracts the tow-rope (FIG. 1, 130) by a set length at a rate that allows the user (FIG. 1, 150) to use the acceleration of the tow-rope (FIG. 1, 130) to accelerate at the moment of jumping the wake of the watercraft (FIG. 1, 120). The acceleration of the tow-rope (FIG. 1, 130) allows the user (FIG. 1, 150) to strike the wake with a greater speed, and causes the user (FIG. 1, 150) to gain higher vertical lift as discussed previously.

The user can then press the extension button (320), or issue a voice command, which causes the transmitter (330) to signal the device (100) to re-extend the tow-rope (130) to its original length or to some other length as desired. The tow-rope device (100) is then set for another retraction as desired by the user.

In another possible example, wherein a winch is used, the winch (FIG. 2, 101) does not retract and extend the tow-rope by only a predetermined length. Rather, the winch (101) retracts the rope as long as the user (FIG. 1, 150) presses and holds down the retraction button (310). Consequently, the user can accelerate for an extended period of time by operating the winch (101) while crossing the wake of the watercraft. Once the user releases the retraction button (310), the wireless transmitter (330) signals to the wireless receiver (350) to stop retracting the tow-rope (FIG. 1, 130). The winch (101) may include a brake to stop the extension of the tow-rope.

The user (FIG. 1, 150) can then press the extension button (320) to signal the winch (101) to re-extend the tow-rope to its original length or to some other length as desired by the user. For example, the rope may be extended as long as the user holds down the extension button (320). In this way, the user can extend and retract the tow-rope as needed to maximize his or her enjoyment of the ride.

In some examples, the radial velocity of the winch is variable. Variable radial velocity makes it possible to have different retraction speeds for the tow-rope (FIG. 1, 130). With different retraction speeds, individual users can use the tow-rope winch at a specific speed that is comfortable and provides the desired acceleration. More adventurous riders may want a faster winch speed and acceleration than less advanced riders.

In other examples, the controls for the tow-rope retraction device (100) may be in the watercraft rather than on the tow-rope handle. In such an example, a person in or on the watercraft would watch the user being towed and would retract and extend the tow-rope for the user, timed, for example, so as to accelerate the user when jumping the wake of the watercraft.

In another example, the winch (101) incorporates a safety feature in that the winch (101) restricts how much of the tow-rope (FIG. 1, 130) can be reeled into the winch (101). This safety feature makes it impossible for the user to ride too close to the watercraft (FIG. 1, 120). Without this safety feature, a user (FIG. 1, 150) may be seriously injured if he or she activates the winch (101) to retract the tow-rope for too long a period of time. The winch (101) would then reel in too much of the tow-rope (FIG. 1, 130) and bring the user (FIG. 1, 150) too close to the propeller or hull of the watercraft (FIG. 1, 120). However, with the safety feature described herein, the winch (101) stops reeling in the tow-rope (FIG. 1, 130) at a predetermined length, keeping the user (FIG. 1, 150) at a safe distance from the prop or hull of the watercraft (FIG. 1, 120).

Figure 4:
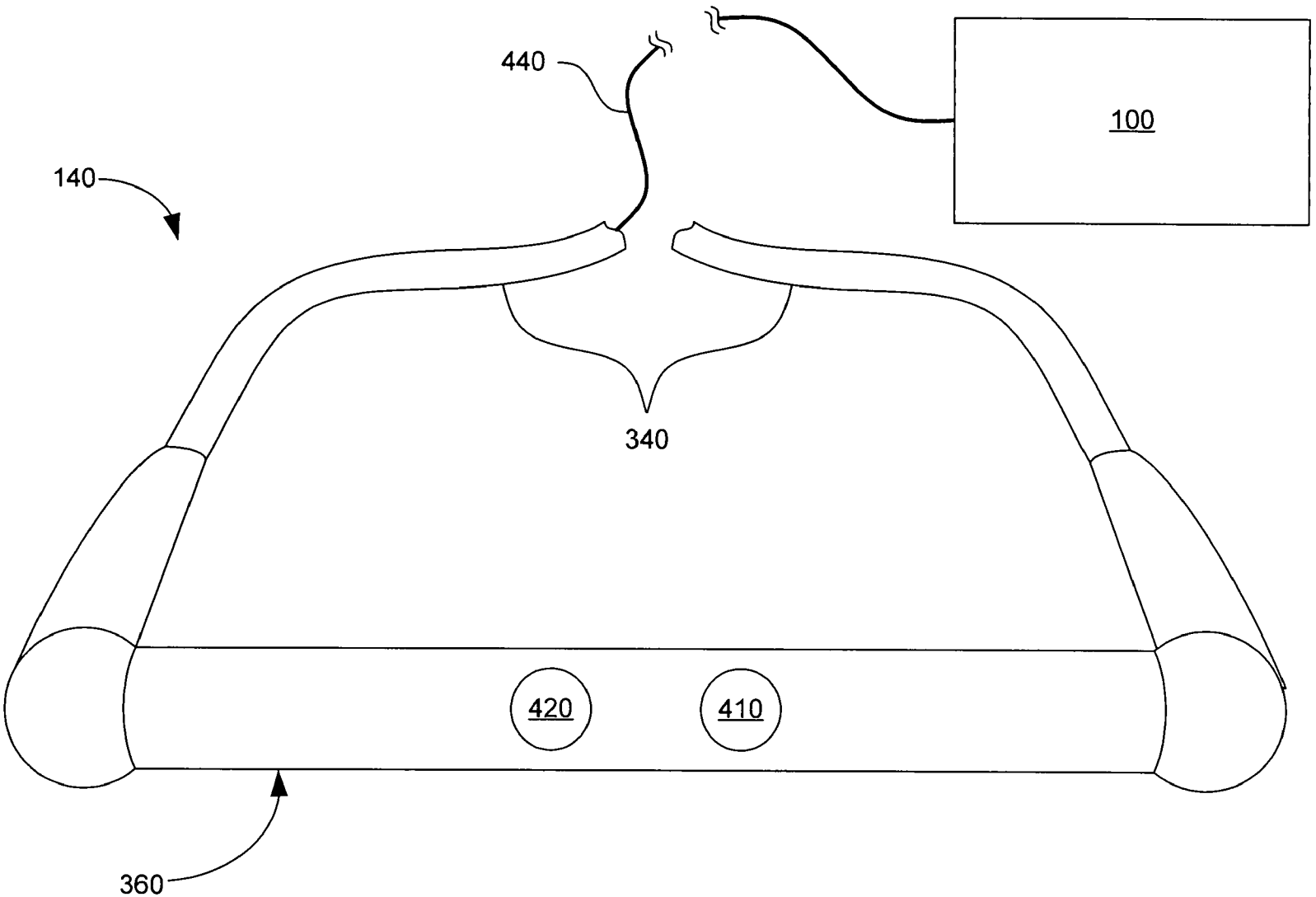
FIG. 4 illustrates a tow-rope handle incorporating an embedded tow-rope wire connected to the tow-rope handle and the winch according to principles described herein.

In another example, FIG. 4 illustrates a tow-rope handle (360) incorporating an embedded command signal wire (440) for carrying command signals from the tow-rope handle (360) to the tow-rope retraction device (100). Unlike the wireless remote previously discussed, communication between the user and the tow-rope retraction device (100) is delivered through the embedded tow-rope wire (440).

When the user pushes the retraction button (410) or issues a voice command, the tow-rope retraction device (100) receives the retraction command through the embedded tow-rope wire (440). The tow-rope retraction device (100) then activates and begins to retract the tow-rope (FIG. 1, 130). The rapid shortening of the tow-rope allows the user (FIG. 1, 150) to accelerate and spring off the wake of the watercraft (FIG. 1, 120). The acceleration of the tow-rope (FIG. 1, 130) allows the user (FIG. 1, 150) to strike the wake with a greater speed, and causes the user (FIG. 1, 150) to gain higher vertical lift as discussed previously. Once the tow-rope retraction device (100) has retracted the tow-rope a predetermined amount, or the user (FIG. 1, 150) releases the retraction button (410) or gives a voice command, the tow-rope retraction device (100) stops retracting the tow-rope (FIG. 1, 130).

After the user (FIG. 1, 150) is finished using the tow-rope retraction device (100), the user (FIG. 1, 150) can then press the extension button (420) or give a voice command. This signals the tow-rope retraction device (100), through the embedded wire (440), to re-extend the tow-rope to its original length or to some other greater length as controlled by the user (FIG. 1, 130). The user (FIG. 1, 150) can cycle between retracting and extending the tow-rope (FIG. 1, 130) as often as desired.

Figure 5:
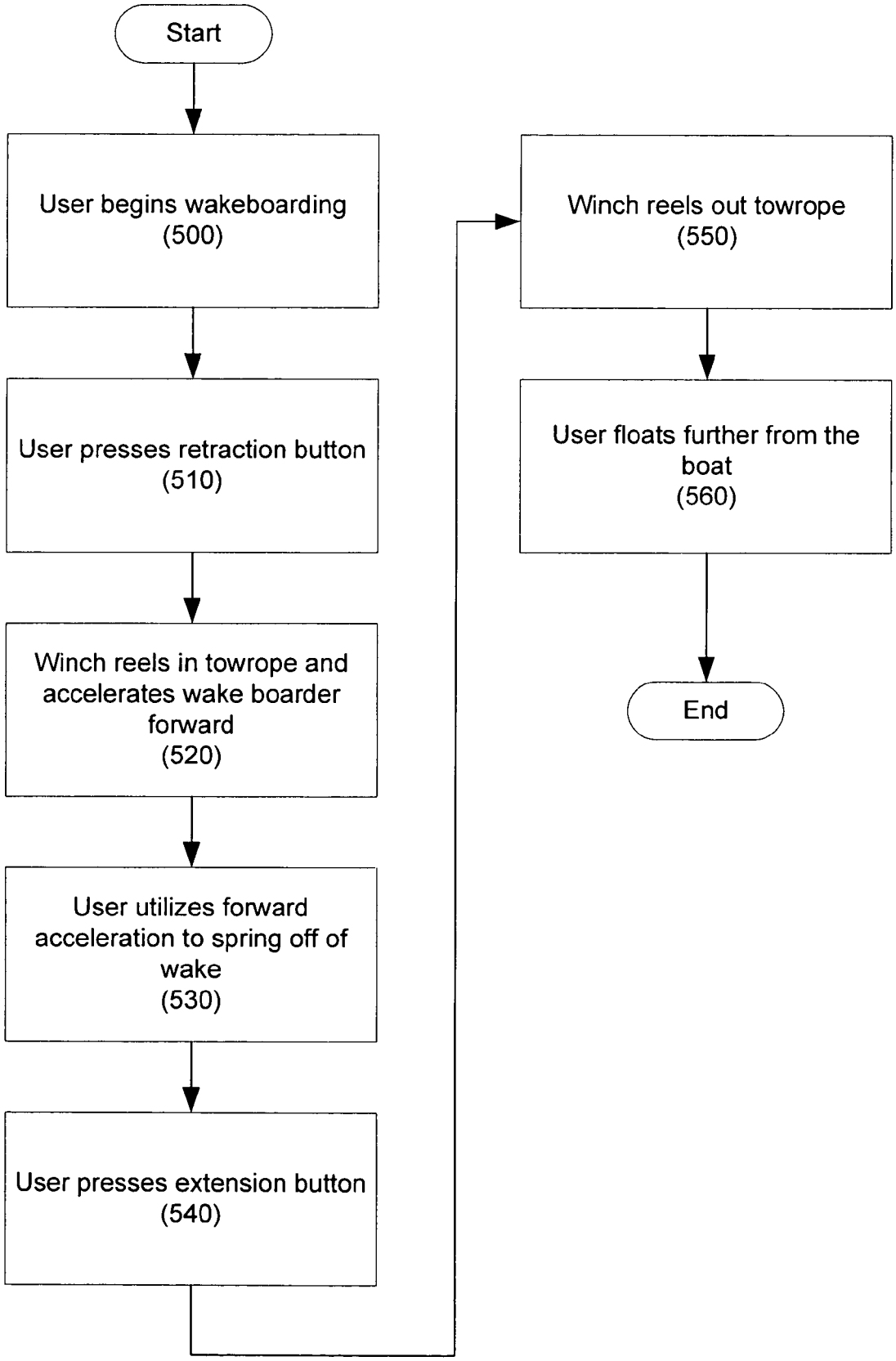
FIG. 5 is a flow chart illustrating an exemplary method of using a tow-rope winch system, according to principles described herein.

FIG. 5 is a flow chart illustrating an exemplary method of using a tow-rope retraction system as described herein. As shown in FIG. 5, the user is towed behind the watercraft and begins, in the illustrated example, to wakeboard (step 500). This step typically involves the user entering the water, putting or strapping on the skis or board, and then allowing the watercraft to pull him or her until both watercraft and user are planing over the water. The user is then free to perform tricks and stunts.

The user then presses the retraction button (step 510) or issues a voice command. This activates the tow-rope retraction device as described above. The tow-rope retraction device, a winch in the illustrated example, then begins to retract the tow-rope (step 520). When the tow-rope retraction device retracts the tow-rope, the user is pulled forward faster due to the combined motion of the watercraft and the retraction of the rope. The user can then utilize this forward acceleration to jump higher off wake of the watercraft (step 530). As described above, the retraction of the rope may be a set, predetermined amount or may be determined by the user.

When the user is finished utilizing the forward acceleration produced by the tow-rope retraction device, the user can then press the extension button or issue another voice command in order to reset the system (step 540). When the user presses the extension button, the tow-rope retraction device extends the tow-rope (step 550). The tow-rope retraction device extends the tow-rope out at a slower rate so the user doesn't experience a sudden decrease in velocity followed by an abrupt jerk as the slack on the tow-rope goes taut. The user can utilize this retraction/extension process as often as desired.

Figure 6:
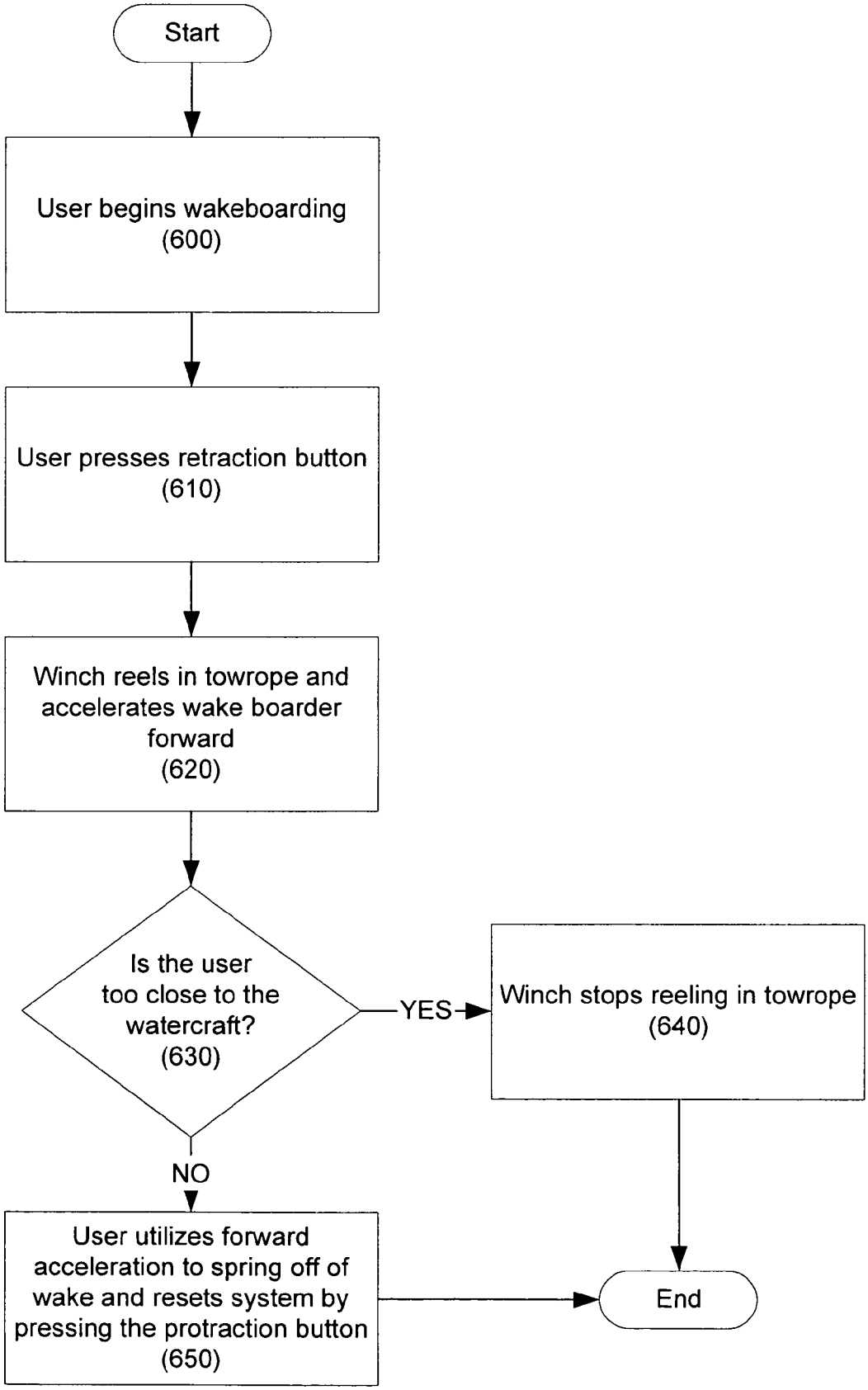
FIG. 6 is a flow chart illustrating an exemplary method of implementing a tow-rope winch safety feature, according to principles described herein.

Finally, FIG. 6 is a flow chart illustrating the use of a tow-rope winch safety feature. As discussed earlier, the user begins to ride behind the watercraft, for example, on a wakeboard (step 600).

The user then presses the retraction button (step 610) or issues a voice command. This activates the winch as described above. The winch then begins to reel in the tow-rope (step 620). When the winch reels in the tow-rope the user experiences an acceleration. The user can then utilize this forward acceleration to jump higher off the wake of the watercraft.

The control system of the winch also determines if the user is coming too close to the watercraft (determination 630). There are several ways in which the winch control system can determine the current extended length of the tow-rope and, thus, the distance of the user from the watercraft. For example, the winch control system may monitor the length of tow-rope extended and retracted, with, for example, a rotational encoder. Alternatively, the winch control system may monitor time and winch speed with, for example, a clock and velocity encoder.

In any case, the system determines if the user is too close to the watercraft by how much of the tow-rope has been wound into the cable drum of the tow-rope winch. If the tow-rope winch control system has determined that the user is not too close to the watercraft, the user can continue to use the tow-rope winch system as described above (step 650).

The user can utilize this retraction/extension process as often as desired. If, however, the tow-rope winch has determined that the user is too close to the watercraft, then the tow-rope winch stops reeling in more tow-rope (step 640).

The preceding description has been presented only to illustrate and describe embodiments of the invention. It is not intended to be exhaustive or to limit the invention to any precise form disclosed. Many modifications and variations are possible in light of the above teaching.

What is claimed is:

1. A device used when towing a user with a watercraft comprising:

a tow-rope;

a tow-rope retraction device receiving said tow-rope;

wherein said tow-rope retraction device is configured to selectively retract said tow-rope with sufficient force so as to accelerate and increase a vertical lift available to a user being towed by said watercraft on said tow-rope as said user is jumping a wake of said watercraft.

2. The device of claim 1, further comprising a wireless transmitter at a handle of said tow-rope for signaling said retraction device to retract said tow-rope and accelerate said user.

3. The device of claim 2, wherein said wireless transmitter also selectively signals said retraction device to extend said tow-rope.

4. The device of claim 1, wherein said retraction device comprises a winch.

5. The device of claim 4, wherein said winch comprises a variable gear box for selectively controlling a speed at which said tow-rope is retracted.

6. The device of claim 1, wherein said retraction device comprises a piston.

7. The device of claim 1, wherein said retraction device comprises a lever.

8. The device of claim 1, wherein said retraction device retracts said tow-rope a predetermined amount upon receiving a signal from said user.

9. The device of claim 1, wherein said retraction device retracts said tow-rope for a period of time controlled by said user.

10. The device of claim 9, further comprising a control system for monitoring a length of tow-rope between said watercraft and said user, said control system permitting selective retraction and extension of said tow-rope beyond a predetermined minimum rope length, but preventing said retraction device from further retracting said tow-rope if said length reaches said predetermined minimum.

11. The device of claim 1, further comprising a signal wire in said tow-rope for communicating commands to said retraction device based on operation by said user of controls on a handle of said tow-rope.

12. A method of towing a user with a watercraft comprising, selectively retracting and extending a tow-rope while towing said user with said tow-rope, said method further comprising timing said retracting of said tow-rope to accelerate said user as said user performs a trick or stunt while being pulled behind said watercraft, said acceleration enhancing said trick or stunt, said extending of said tow-rope being performed after said trick or stunt.

13. The method of claim 12, further comprising reeling in a portion of said tow-rope with a winch as said user is jumping a wake of said watercraft to increase a height achieved by said user.

14. The method of claim 12, wherein said enhancing of said trick or stunt comprises increasing a vertical lift of said user during said trick or stunt.

15. The method of claim 12, further comprising remotely controlling said retracting of said tow-rope with a wireless transmitter at a handle of said tow-rope.

16. The method of claim 12, further comprising adjusting a speed at which said tow-rope is retracted.

17. The method of claim 12, further comprising monitoring a length of said tow-rope between said watercraft and said user, permitting selective retraction and extension of said tow-rope beyond a predetermined minimum rope length, but preventing further retraction of said tow-rope if said length reaches said predetermined minimum.

18. A system for towing a user with a watercraft comprising:

means for selectively retracting a tow-rope with sufficient force to accelerate said user and increase a vertical lift available to said user being towed by said watercraft on said tow-rope as said user is jumping a wake of said watercraft; and means for controlling said means for retracting.

19. The system of claim 18, further comprising means for selectively re-extending said tow-rope under control of said means for controlling.

20. The system of claim 18, wherein said means for controlling are configured to be operated by said user while said user is being towed by said watercraft.

* * * * *